US005137170A

United States Patent [19]

Matias

[11] Patent Number: 5,137,170

[45] Date of Patent: Aug. 11, 1992

[54] FLEXIBLE INSERT AND METHOD OF INSTALLATION WITHIN A GENERALLY RECTANGULAR CONTAINER

[76] Inventor: Carlos J. D. Matias, c/o Cargoship Services Corp., 848 Brickell Ave, Ste. 400, Miami, Fla. 33131

[21] Appl. No.: 729,735

[22] Filed: Jul. 15, 1991

[51] Int. Cl.[5] ..... B65D 88/00

[52] U.S. Cl. ..... 220/470; 220/1.5

[58] Field of Search ..... 220/470, 403, 1.5, 9.1

[56] References Cited

U.S. PATENT DOCUMENTS

| | | | |
|---|---|---|---|
| 2,912,137 | 11/1959 | Taylor | 220/470 X |
| 3,402,845 | 9/1968 | Eriksson | 220/1.5 |
| 3,696,952 | 10/1972 | Bodenheimer | 214/314 |
| 3,868,042 | 2/1975 | Bodenheimer | 220/63 R |
| 3,951,284 | 4/1976 | Fell et al. | 214/152 |
| 3,980,196 | 9/1976 | Paulyson et al. | 220/1.5 |
| 4,054,226 | 10/1977 | Bjelland et al. | 220/1.5 X |
| 4,232,803 | 11/1980 | Muller et al. | 222/105 |
| 4,601,405 | 7/1986 | Riemer | 220/1.5 |
| 4,792,239 | 12/1988 | Hamada et al. | 383/22 |
| 4,863,339 | 9/1989 | Krein | 414/786 |
| 4,875,596 | 10/1989 | Lohse | 220/403 |
| 4,911,317 | 3/1990 | Schloesser et al. | 220/1.5 |
| 5,040,693 | 8/1991 | Dodd, Sr. et al. | 220/470 X |
| 5,059,084 | 10/1991 | Krein | 220/403 X |

FOREIGN PATENT DOCUMENTS 0331491 6/1989 European Pat. Off. .

*Primary Examiner*—Steven M. Pollard

*Attorney, Agent, or Firm*—Robert M. Schwartz; Edward I. Mates

[57] ABSTRACT

A flexible insert for a container is provided with obliquely extending reinforcing straps that connect a door wall portion to a floor portion to make the door wall portion more resistant to deformation when the insert is filled with fluid or particulate cargo. The door wall portion is reinforced by vertically extending reinforcement straps intersecting horizontally extending reinforcing straps to delineate said door wall portion into vertically aligned tiers of horizontally extending sub-portions. Straps extend outward from the insert to attach a roof portion of the insert to aligned cargo rings carried by a roof of the container. Front and rear flaps reversely folded to connect the floor portion to end wall portions are attached to the floor of the container to keep the insert from shifting. Installers need not enter the insert to fix it to the container. Shooters and flaps are included to control loading and unloading.

20 Claims, 7 Drawing Sheets

FLEXIBLE INSERT AND METHOD OF INSTALLATION WITHIN A GENERALLY RECTANGULAR CONTAINER

FIELD OF THE INVENTION

This invention relates to the shipment of bulk materials in shipping vehicles and more particularly to a flexible liner suitable for installation in a standard international container or cargo vessel such as a trailer, truck, rail car or air or seagoing cargo storage space together with a method of installing the flexible insert within a generally rectangular container or cargo storage space. The term "container" will be used hereinafter to cover containers, cargo vessels and cargo storage space. The term "bulk material" includes, but is not limited to substances in the form of powder, pellets, flakes or granules, and also includes liquids. Examples of bulk material include coffee beans, salt, grains and the like.

A large proportion of goods and bulk materials transported today are stored in containers for movement. Many of these containers are of a standard size so that they may be used on both land based vehicles, ships and barges and may also be stacked aboard large seagoing vessels or aircraft. For economic reasons, it has been found desirable to ship bulk materials in containers and in order to do this, a flexible liner has been used in a standard container.

Prior to this invention, flexible containers have been used within standard containers of generally rectangular configuration. However, these containers are susceptible of opening and permitting the load to be lost by spillage when the door to the standard container at one end thereof is opened. There have been cases where laborers working with these containers have been injured during the unloading of the loads stored in these inserts for the standard containers. When cargo is loaded into a flexible insert or when the door of a container provided with a flexible insert is opened for inspecting the cargo, the flexible insert bulges outward, making it difficult and even impossible to reclose the door of the container.

Care must be taken to insure that the insert within the standard container is not applied in such a manner that it is movable within the container, because relative movement between the insert and the container may tear the wall of the flexible insert and cause the contents to spill. Unless steps are taken to secure the floor portion of the insert against the floor of the container and to provide means to attach the upper end or roof portion of the insert to the roof portion of the container and maintain the end walls and side walls of the insert in close relation to the corresponding walls of the container, problems arise. Spillage of material from a torn flexible insert may contaminate the container and make its further use impossible without first requiring very careful cleaning and scrubbing of the container to remove all vestiges of its contents of a previous load. Also, the flexible insert must resist tearing in cases where direct contact of the bulk material with the container would cause the container to contaminate the bulk material, or vice versa. Also, the flexible insert must be composed of a material that is impervious to the cargo with which the insert is loaded.

Many attempts have been made in the prior art to develop a technique of using flexible inserts for standard size containers as will be discussed in a review of patents that came to the attention of applicant's associates in the course of a novelty search.

U.S. Pat. No. 3,696,952, issued Oct. 10, 1972, and U.S. Pat. No. 3,868,042, issued Feb. 25, 1975, to Bodenheimer disclose a flexible bag member adhered at spots to an empty container wall which has bulkheads wedged between the container sidewalls that move with the insertion of a load of bulk material. The bulkhead is provided with suitable openings that are normally sealed during transport to facilitate loading and unloading of the liner within the container.

U.S. Pat. No. 3,951,284 to Fell, et al, issued Apr. 20, 1976, uses a stretchable connector means to support a flexible liner within the adjacent walls of a standard container.

U.S. Pat. No. 4,054,226 to Bjelland, et al, issued Oct. 18, 1977, shows a flexible insert for use within a container. The flexible insert has structural front and rear frames, the front frame retaining the front end of a liner bag in generally rectangular configuration to transmit stresses on the bag to structural members of the container and a laterally curved rear bulkhead supporting the rear end of the bag relative to the standard container to prevent its rupture or collapse during loading or unloading of the flexible insert.

U.S. Pat. No. 4,232,803 to Muller, et al, issued Nov. 11, 1980, shows a system that utilizes a pair of retainers to support a flexible liner within a container. This system requires a two door opening.

U.S. Pat. No. 4,601,405 to Riemer, issued Jul. 22, 1986, discloses a device for closing an open end of a cargo holding sleeve used within a standard container. The device consists of three triangular sheets which are respectively connected at a base edge to separate side walls of the sleeve and the apex portions of the sheets are connected together to cooperate to close the end of the sleeve.

U.S. Pat. No. 4,792,239 to Hamada, et al, issued Dec. 20, 1988, discloses an adjustable belt for hanging a flexible inner bag to the inner wall of a container.

U.S. Pat. No. 4,863,339 to Krein, issued Sep. 5, 1989, discloses applying a vacuum between the outer wall of a flexible bag and the inner wall of a container within which the flexible bag is stored for shipment in order to facilitate removing the air between the flexible bag and the container.

European Patent publication 331,491 to Dorse, published Sep. 6, 1989, discloses a flexible insert bag reinforced by a harness for a snug fit within a container.

U.S. Pat. No. 4,875,596 to Lohse, issued Oct. 24, 1989, discloses a tubular flexible vessel supported within a container spaced from the container walls with its ends closed by a clamp connection.

BRIEF DESCRIPTION OF THIS INVENTION

This invention relates to a flexible bag, of plastic or other flexible material, impervious to the cargo carried, such as canvas or woven jute, that is unfoldable into a shape that approximates the shape of a cargo vehicle or a standard container within which it is applied. The standard container may be suitable for use in an ocean freighter, a trailer for road transportation or a rail car. The invention provides for the safe transport of most bulk materials through a lashing and loading system that suspends the flexible insert from the roof of a container having a roof, left and right side walls, a closed front wall, and a door for opening and closing a portion that would be occupied by a rear end wall. The flexible plastic bag of this invention is provided with a series of flexible straps that cooperate with a plurality of spaced cargo rings attached to the upper portion of the standard container for securing the roof portion of the flexible insert in such a manner that its bottom portion rests in smooth condition on the floor of the container while the wall portions of the insert are adjacent the side walls of the container. The mass of the material that is inserted into the flexible insert does not bear on the insert but on the container because the insert rests with its floor portion on the floor of the container.

Means is provided to reinforce the floor portion of the insert so that the insert may be attached by attachment means, such as nails or screws or the like, through the reinforcing means to the floor of the container to prevent relative sliding of the insert with respect to the container. Front and rear flap portions are also provided for the insert to attach the insert to the floor of a container Also, the attachment of straps extending from the outer surface of the insert to corresponding cargo rings merely suspends the insert within the volume defined by the container so that the floor portion of the insert rests smoothly on the floor of the container.

The rear wall of the insert comprises an end door portion extending upward from the rear end of the floor portion and an upper end flap portion extending rearwardly of the rear of the roof portion of the insert to overlap the end door portion of the insert. A plurality of vertically spaced, horizontally extending reinforcing straps and a plurality of horizontally spaced, vertically extending reinforcing straps are provided on the end portion of the flexible insert and a plurality of obliquely extending reinforcing straps are also included.

Each oblique reinforcing strap has a forward end connected to said container at either its floor or its cargo rings and a rearward end secured to at least one of the reinforcing straps in the end door portion. When the insert is loaded with cargo, the obliquely extending reinforcing straps become taut to support the end door portion in a position to prevent the end door portion of the insert from bulging outward beyond the door of the container. This structure keeps the granular material or liquid that is stored within the insert from bulging out beyond the confines of the container. In addition, various flaps are provided to control a portion of the stored material that is to be unloaded from the insert within the container. The horizontally extending and vertically extending reinforcing straps intersect one another to provide means for reinforcing the door portion of the insert and also provides preferred means for securement to upper rearward ends of the oblique straps that interconnect the reinforcing horizontal and vertical reinforcing straps secured to the end door portion of the insert so that the oblique reinforcing straps when tightly stretched support the end door portion vertically. The flexible insert is so constructed and arranged that it can be attached directly to a container without requiring an installer to enter the insert during said attachment.

In a preferred embodiment, upper strap means extend upwardly from the front end portion and the side portions of the insert to cooperate with a plurality of cargo rings spaced along the length of the upper left and right corner portions formed between the left and right side walls and roof of the container so that the flexible insert may be installed in a folded condition within the container with its front flap portion resting on the front of the floor of the container and the forward portion of the floor portion of the insert extending rearward from its front flap position to a transverse area containing lower forward ends of the oblique reinforcing straps resting flat on the corresponding portion of the container floor. After securing the front flap portion and the lower forward ends of the oblique reinforcing straps to corresponding portions of the container floor to retain the front floor portion of the insert flat against the front portion of the container floor, the outwardly extending straps are connected to the cargo rings from front to rear with additional floor portion reinforcements, if any, attached from front to rear of the container floor securing all the straps to cargo ring attachments desired and working back, securing front and rear flap portions of the insert and the lower ends of the oblique reinforcing straps to the floor of the container.

The end door portion of the insert is subdivided into a number of end door sub-portions by the crisscrossing of vertically extending reinforcing straps and horizontally extending reinforcing straps. Each of the end door sub-portions may have readily openable flaps to provide access for selectively unloading a portion of the load supported within the insert within the container as desired at a controlled rate of outflow. This manner of locally opening different portions of end door portion avoids the sudden rush of stored material that can be harmful to personnel working on the unloading job.

These and other benefits of this invention will become obvious after a description of a preferred embodiment and certain modifications thereof is studied.

DESCRIPTION OF THE DRAWINGS

In the drawings that form part of a description of various embodiments of this invention.

DESCRIPTION OF PREFERRED EMBODIMENTS

Figure 1:
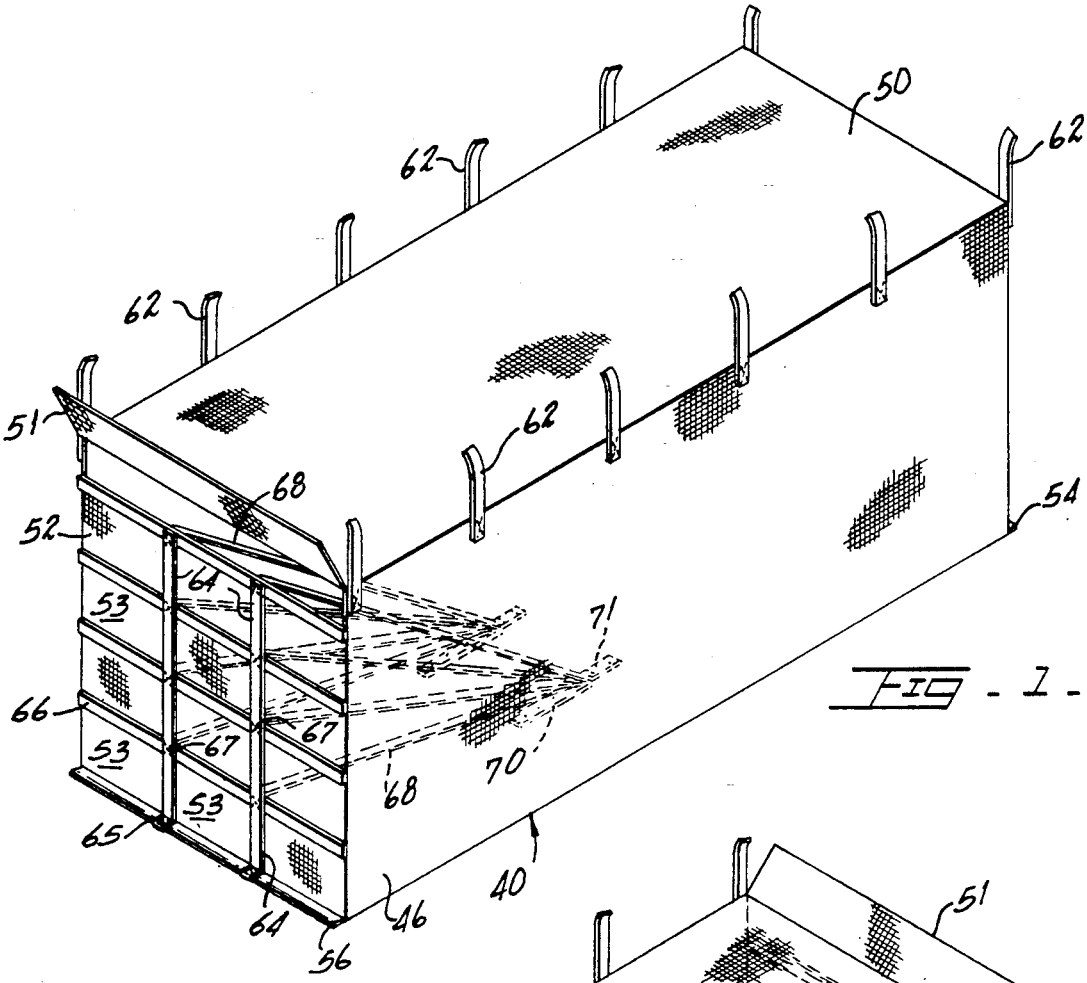
FIG. 1 is an isometric view of a flexible liner showing its shape when inserted within a rigid container and looking from the rear of the door portion of the flexible insert.

Referring to the drawings (FIGS. 3, 4, 5 and 7D), a container 20 comprises a metal frame 21 reinforcing a floor 22 (composed of wood or the like) from which extend upwardly a right side wall 24 (FIG. 5) a left side wall 26 and a closed front end wall 28. A roof 30 interconnects the upper ends of right side wall 24 and left side wall 26 and also extends from the closed frotn end wall 28 to a door wall 32. The container is of rectangular cross-section in both elevation and plan and may be associated with a truck, a freighter, a railroad car or aircraft. The walls, roof and floor of container 20 are essentially planar, however the term "planar" as herein defined includes standard container walls that may be of either flat or corrugated shape.

A flexible insert 40 of plastic material of this invention (FIGS. 1 and 2) comprises a floor portion 42 that rests smoothly on the floor 22 of the container when installed, a left side wall portion 44 that extends adjacent left side wall 24 of the container, a right side wall 46 that extends adjacent the right side wall 26 of container 20, a closed end wall portion 48 that extends upwardly adjacent closed end wall 28 of container 20, and a roof portion 50 that extends substantially coextensively below roof 30 of container 20. Roof portion 50 extends at its rear end into an upper end flap portion 51, and an end door portion 52 extends upward from the floor portion 22 of insert 40 inside door wall 32 of container 20 when installed. End door portion 52 is subdivided into end door sub-portions 53 in a manner to be described later. The upper end flap portion 51, which extends outwardly beyond end door portion 52, forms a flap that is selectively closed or open, the open position being depicted in FIGS. 1 and 2.

Figure 11:
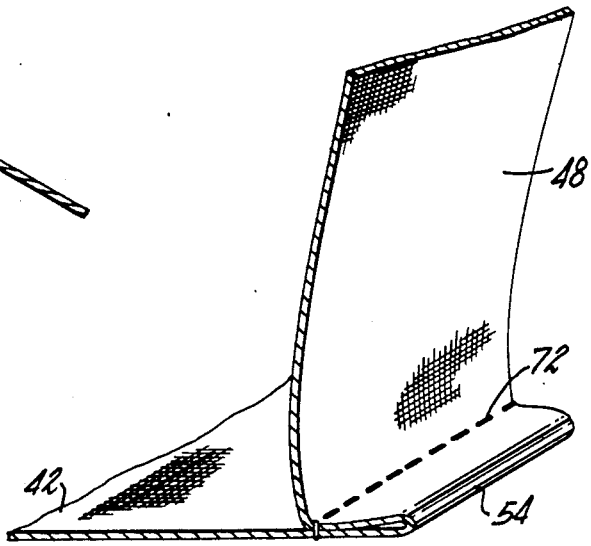
FIG. 11 is an isometric enlarged view of a portion of the closed end wall portion of the flexible insert near the end of its floor portion to show how a folded front flap portion interconnects the floor portion of the insert to its front wall portion.

Floor portion 42 is reversely folded and sewn at 72 (FIG. 11) at its forward end to form a front flap portion 54 that connects the front end of floor portion 42 and the lower end of closed wall portion 48. A rear flap portion 56 is similarly reversely folded and sewn to form an extension of the rear end of floor portion 42 that is curved upward into the lower part of end door portion 52. The number of reversing folds for front flap portion 54 and rear flap portion 56 need not be limited to the two shown in the figures as long as the flap portions are strong enough to receive securing means, such as nails, screws and the like, that secure the flexible insert 40 to the floor 22 of container 20 and maintain floor portion 22 smooth, as will be described later.

Figure 8:
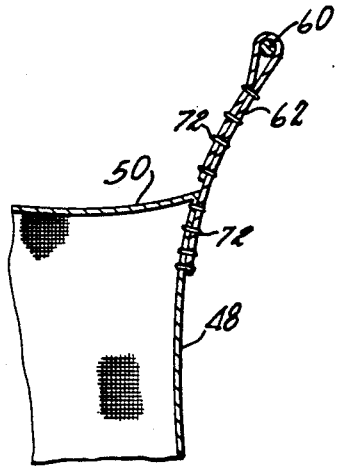
FIG. 8 is an enlarged sectional view of the upper right hand corner of the view of FIG. 7B illustrating one type of top strap for securing the upper right corner of the roof portion of the insert to the upper right portion of the roof of the container within which the insert is installed.
Figure 7B:
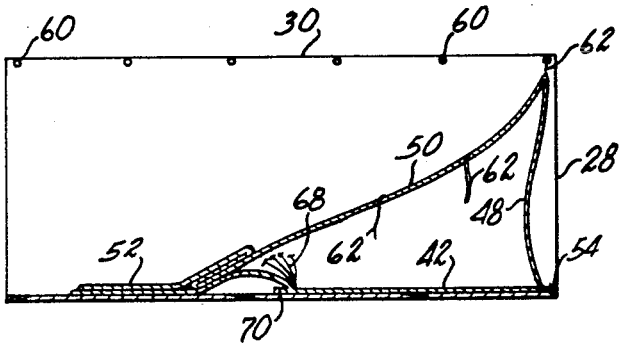
Figure 7C:
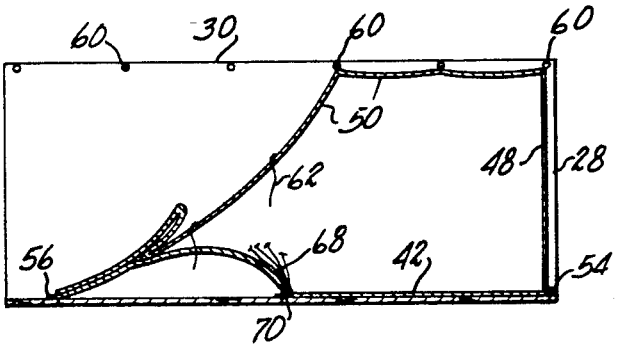

At the upper portion of the container 20 where the roof 30 meets each of the side walls 24 and 26 and optionally, front end wall 28 and door wall 32, a plurality of longitudinally spaced cargo rings 60 are arranged from innermost (forward) to outermost (rearward) rings. A flexible top strap 62 that may be constructed of reinforced fabric, such as used in automobiles seat belts, is provided for as many of cargo rings 60 as needed. Preferably, a unique strap 62 is provided for each cargo ring 60. A typical arrangement is shown in FIGS. 7A through 7D. FIG. 8 shows how a typical top strap 62 is sewn at 72 into an upper portion of closed wall portion 48 and looped through a top cargo ring 60. Additional top straps 62 arranged from innermost to outermost straps to correspond to the positions of cargo rings 60, are connected to extend upwardly from side portions 44 and 46 and are threaded through top cargo rings 60, then sewn together at 72 to form loops extending through corresponding cargo rings so that the flexible insert 40 is suspended from the roof 30 of container 20 with the floor portion 42 resting smoothly on floor 22 of container 20.

Figure 9:
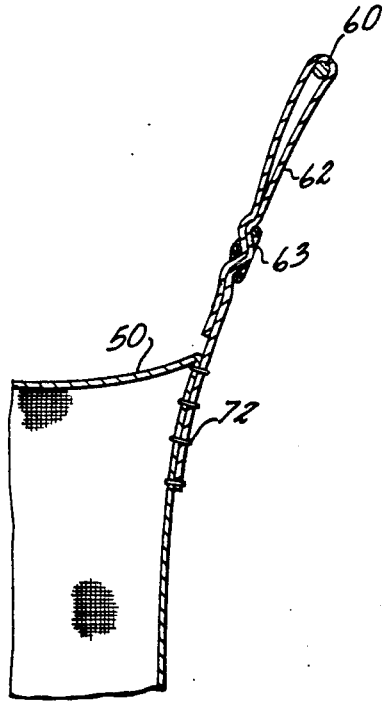
FIG. 9 is a view similar to FIG. 8 of an alternate embodiment of a top strap that incorporates a buckle.
Figure 7D:
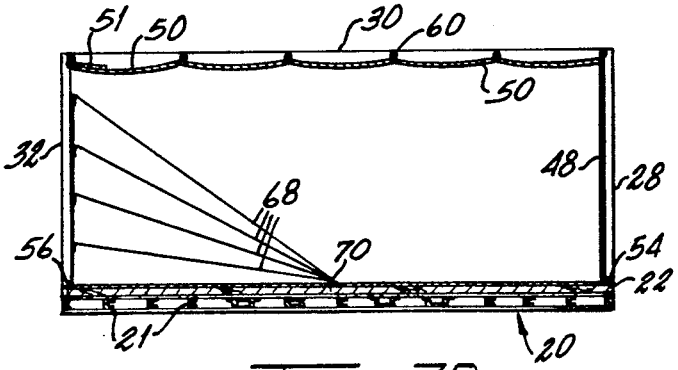

FIG. 9 shows an alternative embodiment of top strap 62 in which the strap is adjustable in length through the use of a buckle 63 through which strap 62 is threaded.

End door portion 52 is sub-divided into a plurality of end door sub-portions 53 arranged in checkerboard arrangement shown in FIG. 1. Sub-portions 53 are defined by a plurality of horizontally spaced vertical reinforcing straps 64 having lower ends 65 fixed to rear flap portion 56 by sewing and vertically spaced horizontal reinforcing straps 66 that form intersections 67. Thus, sub-portions 53 are arranged in horizontally extending tiers.

Figure 6:
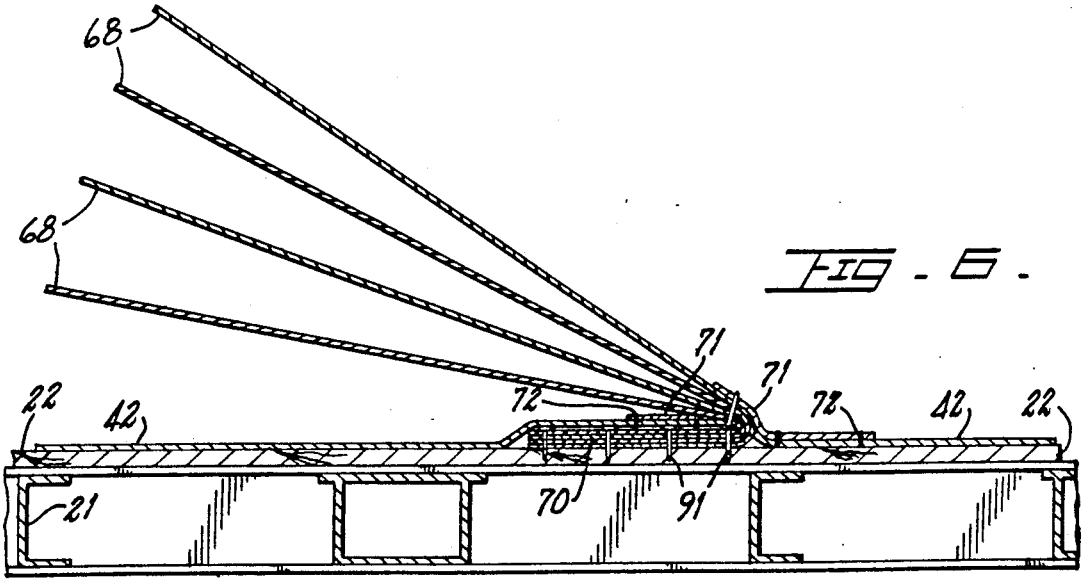
FIG. 6 is an enlarged view of a portion of FIG. 3 showing in detail how one of the arrangements for attaching the lower end of one set of interior oblique straps to the floor portion reinforcement of the insert is arranged.
Figure 7A:
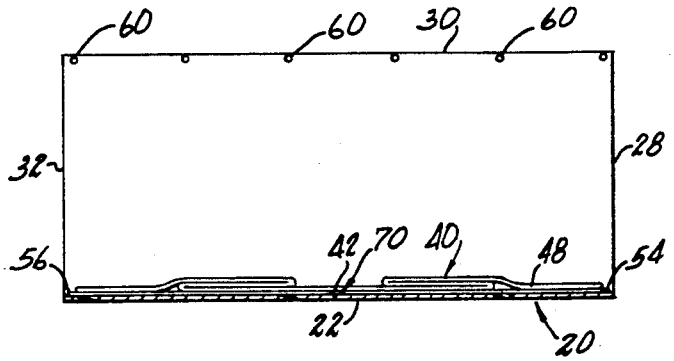
FIGS. 7A, 7B, 7C and 7D are a series of schematic elevational views showing different steps during a preferred method of installing a flexible liner of this invention within a cargo container.

Flexible insert 40 is provided with a plurality of oblique reinforcing straps 68, each having a downwardly folded upper rear end 69 and a rearwardly folded forward lower end 70. The upper rear end 69 of each oblique strap 68 is folded downward and attached to a vertically extending reinforcing strap 64 and a horizontally extending reinforcing strap 66 at a unique intersection 67 for each oblique strap 68. The lower end 70 of each obliquely extending reinforcing strap 68 extends through a slot of a series of transversely spaced slots in floor portion 42 and is folded to the rear for attachment to floor 22. Flap means 71 is provided to close any slot receiving the folded lower end 70 of each oblique strap 68 and to reinforce floor portion 42 further in the vicinity of each strap receiving slot. Flap means 71 are sewn to floor portion at 72 in FIG. 6. FIG. 6 also shows in detail how a typical attachment of oblique reinforcing straps 68 is made through their lower ends 70 and nailed at 91 to container floor 22.

Figure 10A:
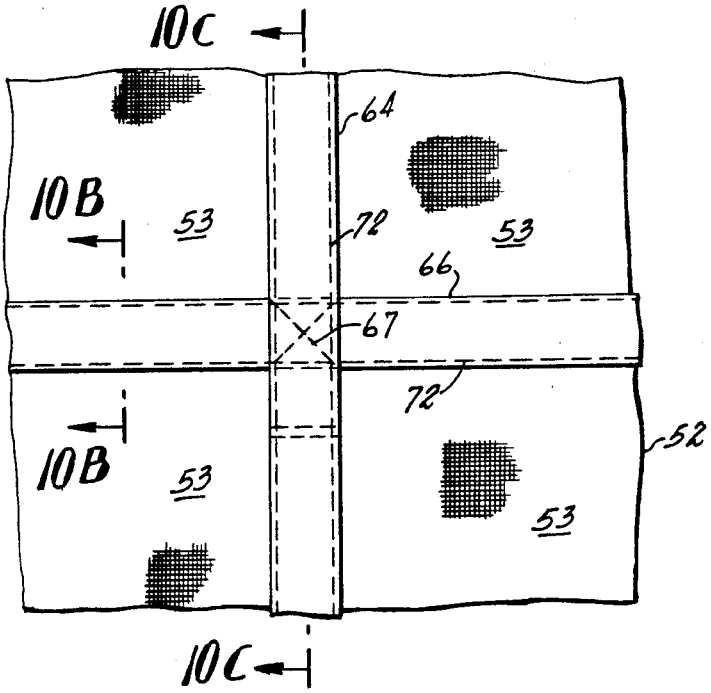
FIG. 10A is a fragmentary elevational view of a localized portion of an end door portion of the flexible insert.
Figure 10B:
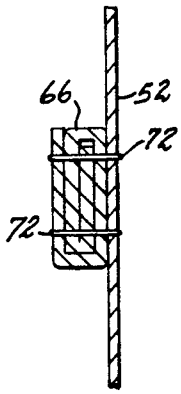
FIG. 10B is a view taken along the lines 10B—10B of FIG. 10A.
Figure 10C:
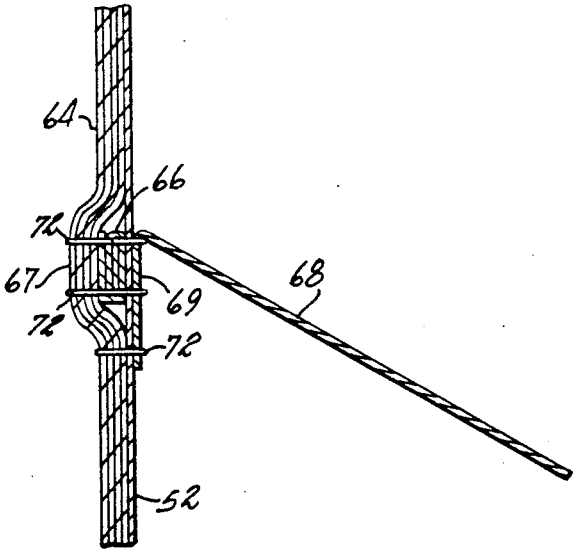
FIG. 10C is a cross-section taken along the line 10C-10C of FIG. 10A.

FIGS. 10A, 10B and 10C show how the upper ends 69 of oblique reinforcing straps 68 are attached to the end door portion 52 of flexible insert 40, preferably at the intersections 67 of vertically extending reinforcing straps 64 and horizontally extending reinforcing straps 66. Note that reinforcing straps 64 and 66 are reversely folded for improved strength and are interconnected by sewing 72. However, the reinforcing straps need not be folded if they are constructed of heavier thicker materials having the strength available from automobile seatbelts.

Figure 3:
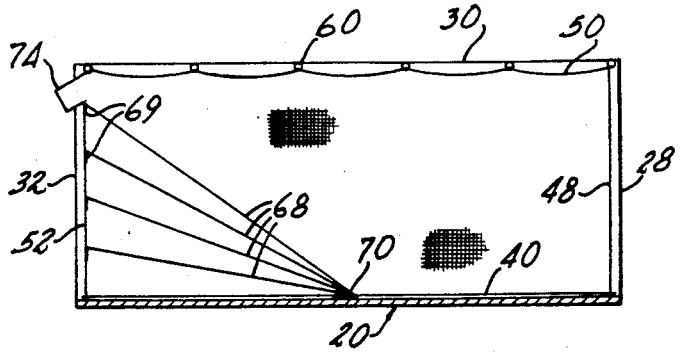
FIG. 3 is a side elevational view of the flexible insert of FIGS. 1 and 2, showing one of several alternate methods of securing a plurality of oblique reinforcing straps, each constructed to extend between lower forward ends attached to a floor portion and upper rearward ends attached to end door portion reinforcements to prevent outward bulging of the end door portion of the flexible insert when the insert is installed within the container and loaded with cargo.
Figure 4:
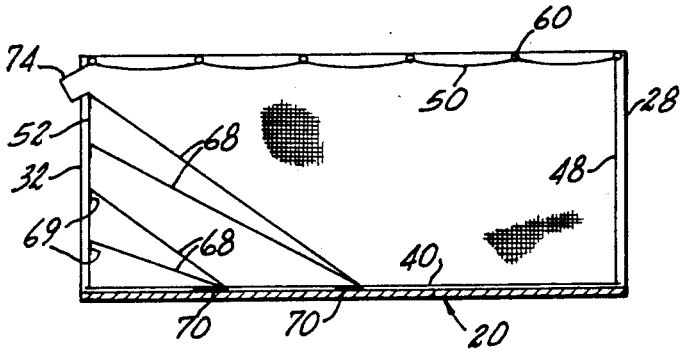
FIG. 4 is a view similar to FIG. 3 of a second embodiment of interior oblique strap arrangements.
Figure 5:
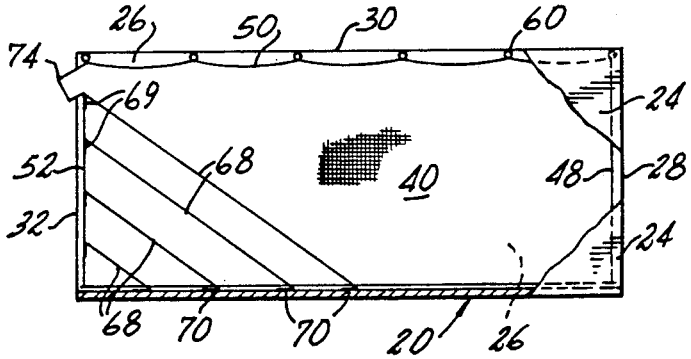
FIG. 5 is a view similar to FIGS. 3 and 4 showing a third embodiment of interior oblique strap arrangements.

Several methods of attaching the lower ends 70 of oblique reinforcing straps 68 to floor portion 42 beneath covering and reinforcing flaps 71 are depicted in FIGS. 3, 4 and 5. Each lower end 70 is reversely folded and attached to floor 22 of the container 20. The lower ends 70 are nailed at 91 or otherwise attached to floor 22 near flaps 71. The upper ends of oblique reinforcing straps 68 are preferably attached by sewing upper ends 69 at the intersections 67 to vertically extending reinforcing straps 64 and horizontally extending reinforcing straps 66 to form the checkerboard arrangement of end door sub-portions 53. An observation flap 73 may be provided on flap 51 to provide access for the visual inspection, sampling or removal of contents. One or more loading and exhaust pipes 74 may be provided to remove exhaust air and fumes, etc. when cargo is introduced.

Figure 2:
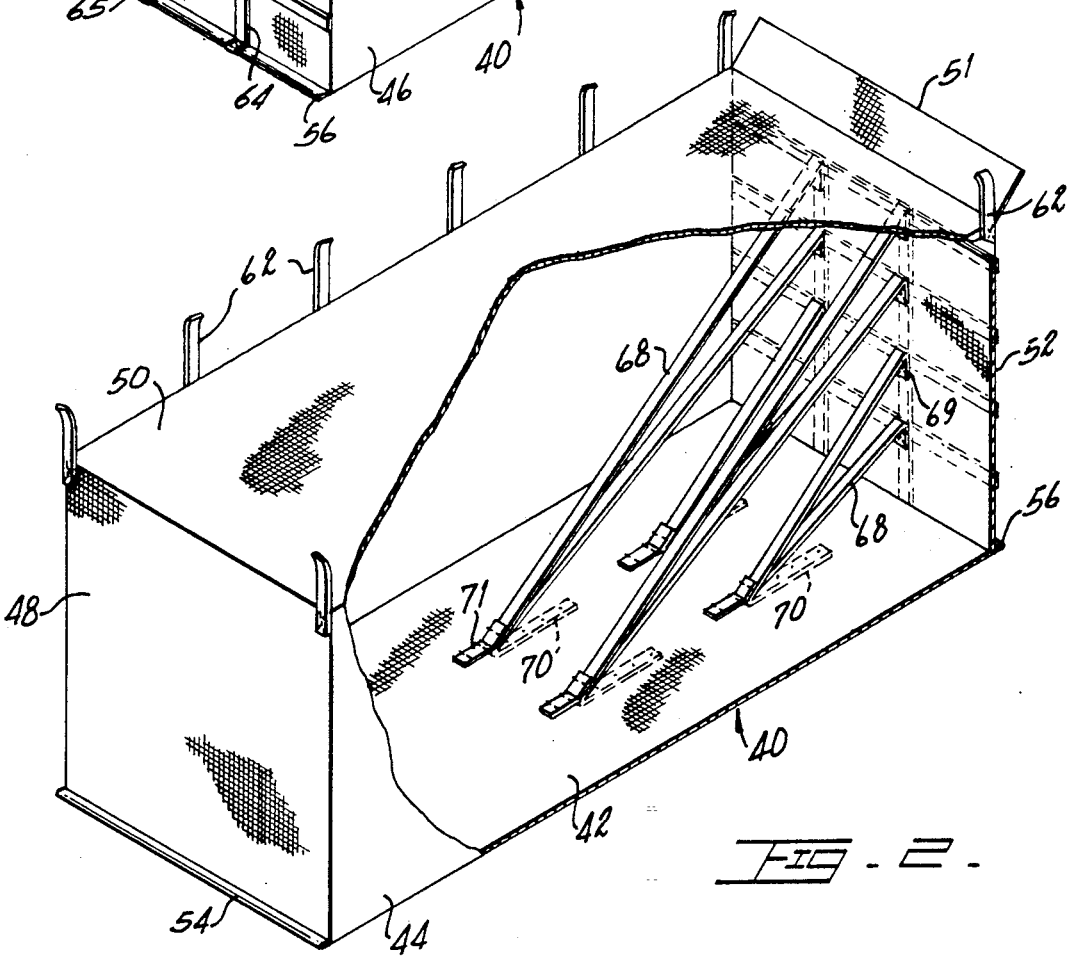
FIG. 2 is a partially cut-out isometric view from the front of a front end portion of a flexible insert or liner open to show some of the inside strap reinforcement arrangements but omitting any straps that interconnect the insert to the container within which the flexible insert or liner is applied.

The oblique reinforcing straps 68 are composed of plastic material of low stretchability, about 1/8 to 1/4 inch thick and 3 to 4 inches wide, for example, and may be attached at transversely spaced locations at their lower ends along a single transversely extending area of attachment only and extend upwardly to different tiers of intersections 67 of horizontally extending reinforcing straps 66 with vertically extending reinforcing straps 64 as shown in FIGS. 1, 2 and 3. Alternately, the lower ends 70 of oblique reinforcing straps 68 may be attached to floor 22 along different transverse areas at longitudinally offset locations as depicted in alternate embodiments in FIGS. 4 and 5.

Figure 12A:
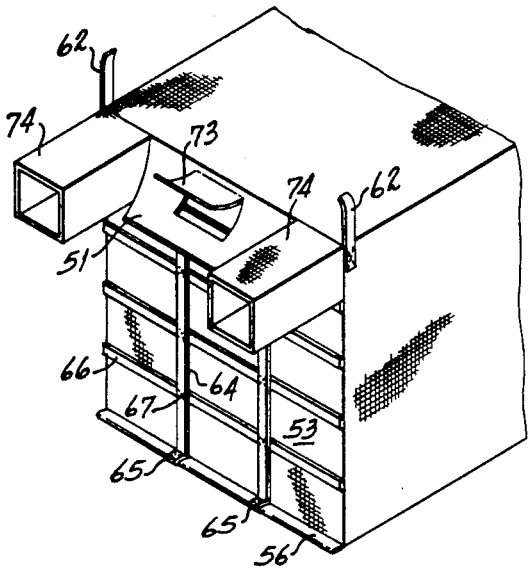
FIG. 12A is an isometric view looking at the outside of the end door portion of the insert modified by a flapped end sub-portion flanked by a pair of loading and exhaust pipes.
Figure 12B:
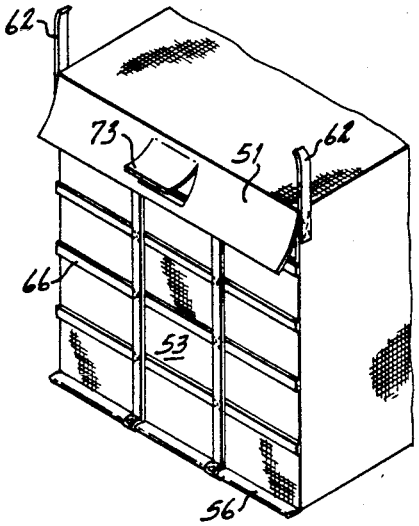
FIG. 12B is a view similar to FIG. 12A showing an alternate construction of the upper flap portion with a local flap as in FIG. 12A but omitting the loading and exhaust pipes.

Upper flap portion 51 may be provided with an observation flap 73 as shown in FIGS. 12A and 12B. Loading and exhaust pipes 74 may extend completely across the width of the end door portion 52 as in FIG. 12C or may flank opposite sides of an upper flap portion 51 as depicted in FIG. 12A. An additional flap 151 may be provided as shown in FIG. 13 in case of large loads where additional support is needed to hold the larger cargo. A probe, not shown, may be inserted into any end door sup-portion 53 desired to sample the cargo. Supplemental straps 89 (FIG. 12C) are used to secure exhaust pipe 74 in a closed condition, preferably by sewing or tying. Supplemental straps 89 may also be used in FIG. 12A if desired even though omitted from the drawing.

A typical technique for installing a flexible insert 40 within a container 20 is depicted in FIGS. 7A through 7D. Initially, flexible insert 40 is inserted in folded flat condition with its floor portion 42 disposed over the floor 22 of container 20 and front flap portion 54 adjacent end wall 28. Rear flap portion 56 is folded toward forward flap portion 54 and a transversely extending area containing lower forward ends 70 is exposed for nailing. Since container doors (not shown) are open, it is possible to enter container 20 to nail front flap portion 54 to the front end of floor 22, nail forward ends 70 to container floor 22, unfold insert 40 to the rear, and lift the innermost top straps 62 adjacent the front corners adjacent closed end wall 28 of container 20 to loop through corresponding innermost top cargo rings 60 and secure the front of roof portion 50 to the front of roof 30. If it is desired to have the insert reusable, it is suggested that a buckle 63 be used to tighten the strap 62 so as to lift the roof portion 50 of flexible insert 40 upward toward the top cargo rings 60 at the front upper corners of the container 20. Before the securement is made at the upper top corners, the front flap portion 54 of flexible insert 40 is nailed to the floor 22 adjacent closed front end wall 28. Then going from right to left, as appears in FIGS. 7B, 7C and 7D, the flexible insert 40 is lifted with additional top straps 62 from right to left being attached securely to the rings 60 until a portion of the length of the roof portion 50 is suspended. Insert 40 has been prefabricated with flaps 71 covering slots through which lower ends 70 extend to prevent loss of cargo from insert 40. As the latter is unfolded within the container 20, and smoothed, lower ends 70 folded rearwardly from floor portion slots are exposed to be nailed to floor 22. Lower ends 70 of oblique straps 68 are nailed to floor 22 of container 20 after the forward portion of floor portion 42 is smoothed to make it unwrinkled. Flaps 71 are pre-sewn to floor portion 42 to close the slots through which lower ends 70 extend. Also, roof portion 50 is suspended by spaced suspension points provided by the spaced connections of the remaining top straps 62 to corresponding spaced top cargo rings 60 along the length of the roof. After the flexible insert 40 becomes fully unfolded, rear flap portion 56 is nailed to the rear of floor 22. Now, insert 40 is suspended at its roof portion 50 by the connections between top straps 62 and top cargo rings 60 and the attachment of front flap portion 54, lower ends 70, and rear flap portion 56 of flexible insert 40 to floor 22 of container 20. Thus, the insert 40 obtains the shape depicted in FIG. 7D. Obliquely extending reinforcing straps 68 when taut increase the resistance of end door portion 52 to deform in response to outward pressure of a cargo.

Upper end flap portion 51 is lifted and material to be shipped is inserted through spaces covered by flap portion 51 flanked by exhaust pipes 74 to load insert 40 with material to be shipped. Pipes 74 are of sufficiently large cross-section to leave room for exhausting air when insert 40 is loaded rapidly. Inner closed end wall portion 48 is lifted by tightening top straps 62 at the inner end of the insert for the container to a level depicted in FIG. 14 where the heights X, Y and Z of horizontally extending reinforcing straps 66 of the end door sub-portions 53 are sufficient to enable flexible end door portion 52 to maintain a predetermined normal load inserted into the flexible insert 40 forward of door wall 32 without bulging. Flap 51 is then closed and sewn if necessary, and pipes 74 are rolled and tied up when loading is completed to insure that the load of granular material is maintained within the flexible insert 40 for container 20 during transport of the load from the loading station to the unloading station.

Figure 14:
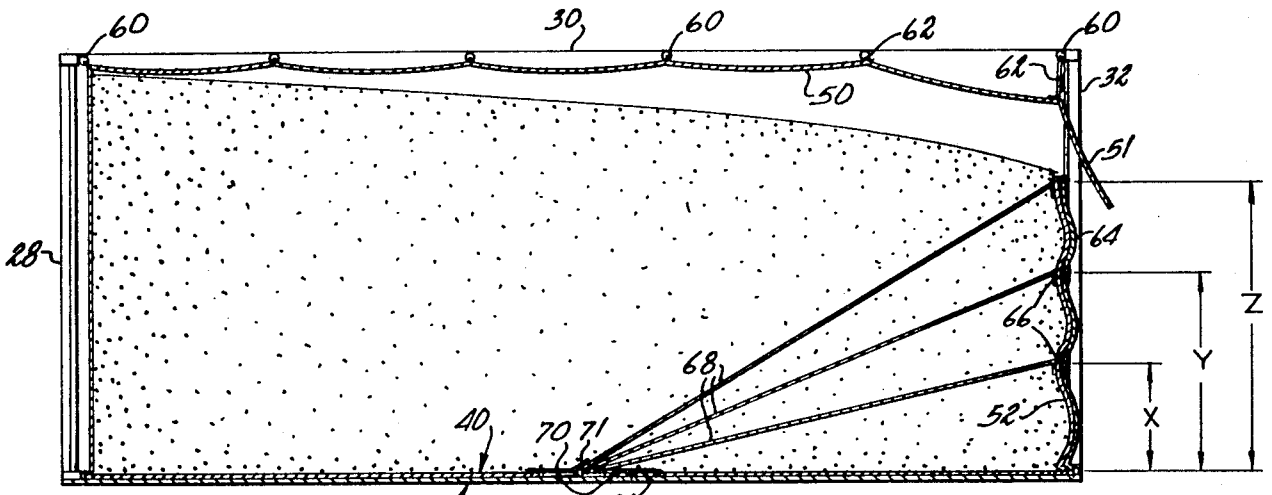
FIG. 14 is an elevational schematic view showing how the end door portions of the flexible insert are arranged for a relatively small load.
Figure 15:
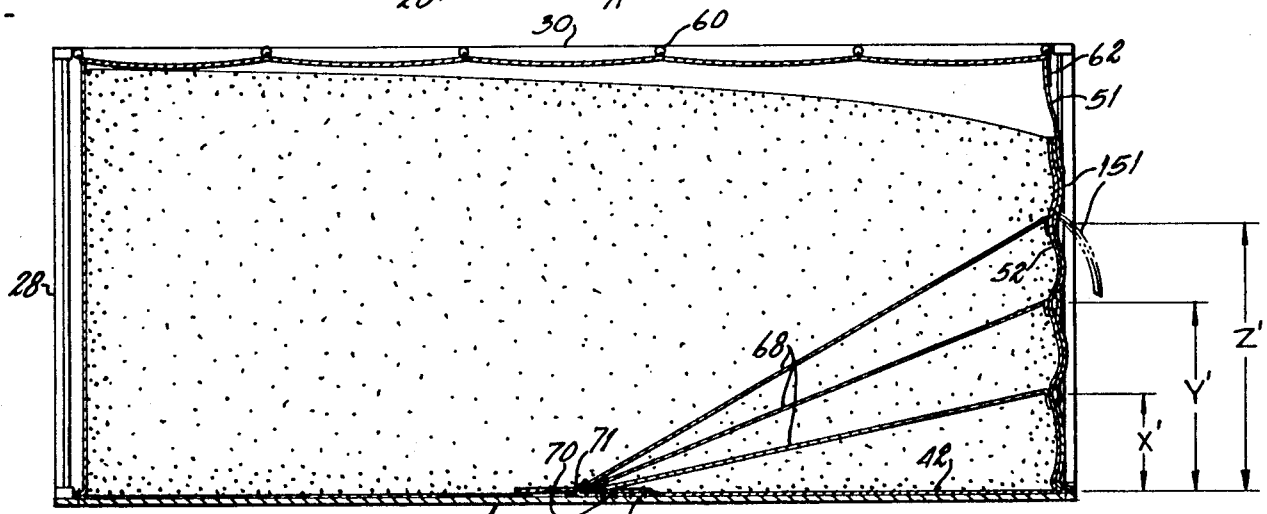
FIG. 15 is a view similar to FIG. 14 showing how the end door portion of the flexible insert is arranged with the supplemental flap portion of FIG. 13 when a larger load than that of FIG. 14 is loaded into the container.

If the load within container 20 is larger than depicted in FIG. 14, as shown in FIG. 15, then an auxiliary flap 151 is provided for end door portion 52 at the right end of the figure and is sewn to the side walls 44 and 46 during or prior to loading to augment the height of the lower three levels or tiers of end door portion 52 above heights equal to X', Y' and Z', respectively and enable auxiliary flap portion 151 below the flap portion 51 to withhold the load above level Z' as depicted in FIGS. 13 and 15. FIG. 15 shows auxiliary flap 151 in phantom hanging down and in full lines supplementing the height of end door portion 52.

Figure 16A:
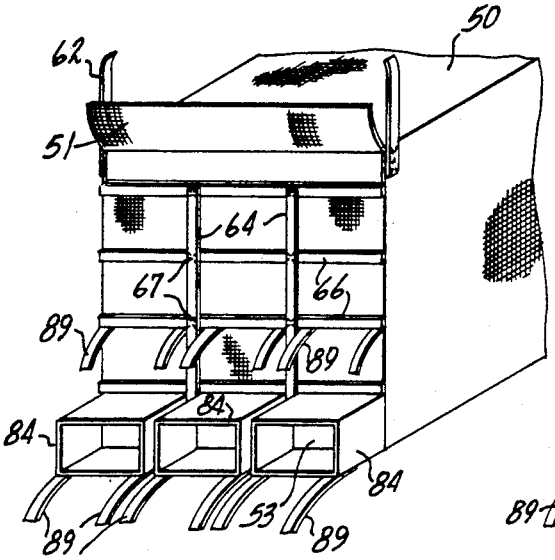
FIGS. 16A, 16B, 16C and 16D are isometric end views of the door portion of the flexible insert while unloading a cargo, FIG. 16A showing the use of three shooters, FIG. 16B showing an enlarged shooter, FIG. 16C showing an alternate construction of an unloading shooter and FIG. 16D showing an end arrangement without a shooter at the bottom, and also including an alternate structure in which a selected oblique reinforcing strap is secured at one end to a selected cargo ring.
Figure 16B:
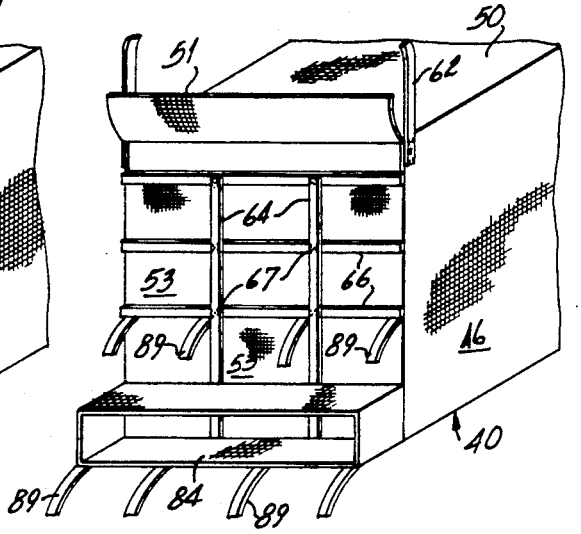
Figure 16C:
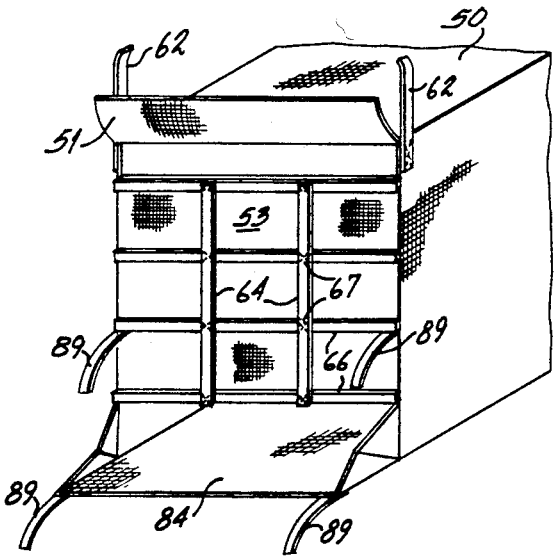

It is possible to use shooters 84 as a means for unloading the contents from within the flexible insert 40 without causing a load to be emptied at such a severe rate that it presents a danger to unloading personnel. Various alternative arrangements for unloading devices or shooters may be provided such as depicted in FIGS. 16A, 16B and 16C. Also, it is understood that shooters 84 may be rectangular in cross-section to conform to the rectangular shape depicted for the end door sub-portions 53 and these may be opened according to a desired program as the flexible insert 40 is unloaded. By programming the position from side to side where access openings for the sub-portions 53 are opened, dangerous accidents are avoided.

The drawings show different variations of this invention. For example, in FIGS. 3, 6 and 7D, all the oblique reinforcing straps 68 are attached at their lower, forward ends 70 along a common transverse area of attachment and extend upwardly and rearwardly to their upward and rearward ends 69 attached to the intersections 67 of different vertically extending reinforcing straps 64 and horizontally extending reinforcing straps 66 at different tiers so that oblique reinforcing straps 68 radiate upward to a taut condition in different directions from a common transverse area of attachment when end door portion 52 is lifted to enable end door portion 52 to retain a cargo of liquid or pulverulent material. In FIG. 4, as in FIGS. 1 and 2, two sets of oblique reinforcing straps 68 are provided, with the lower, forward ends 70 of some of oblique straps 68 attached to floor 22 along a forward transverse area of connection to extend upward and rearward to the upper intersections 67 while the remaining oblique straps 68 are attached to a rear portion of floor 22 along a second or rearward transverse area of connection to radiate upward and rearward to lower intersections 67. In FIG. 5, the oblique straps 68 are arranged in a different set of transversely spaced oblique straps attached at their lower forward ends 70 to different transverse areas of connection along the length of floor 22. The forwardmost ends 70 of oblique straps 68 interconnect floor 22 along a forwardmost transverse area of connection with the intersections 67 of vertically extending reinforcing straps 64 and horizontally extending reinforcing straps 66 along the uppermost tier of sub-portions 53. In this latter embodiment, successive sets of oblique straps 68 have their lower, forward ends 70 attached to successive transverse areas of connection spaced rearwardly of one another and extending upwardly and rearwardly to intersections 67 located along successive tiers, each lower than the previous attached tier, to develop the arrangement shown in FIG. 5.

Figure 12C:
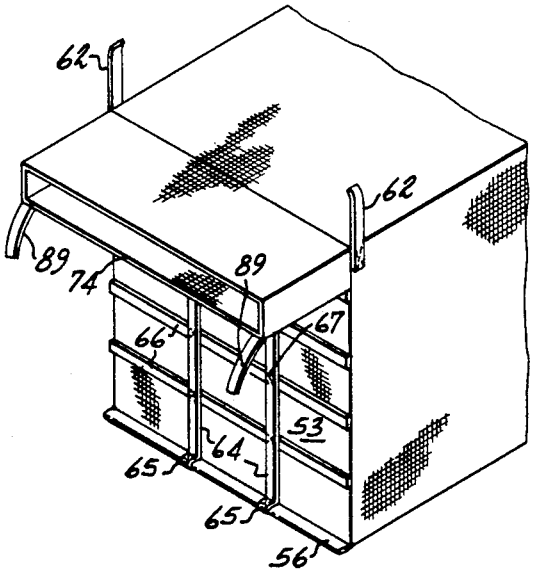
FIG. 12C is a view similar to that of FIGS. 12A and 12B showing an alternate embodiment of end door portion for the insert having a single loading and exhaust pipe extending across the entire width of an upper tier of end door sub-portions.
Figure 13:
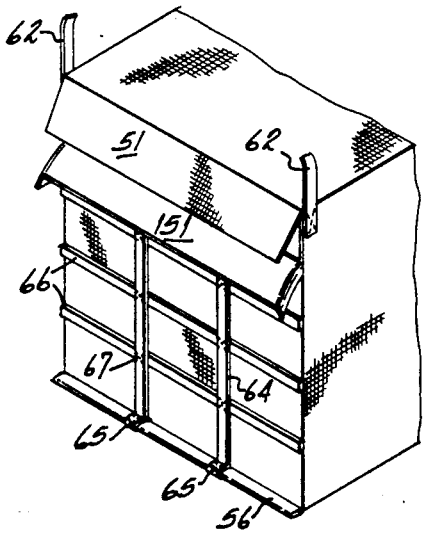
FIG. 13 is a view similar to those of FIGS. 12A, 12B and 12C showing still another embodiment of an end door portion that comprises a supplemental flap portion.

Referring to FIGS. 12A , 12B, 12C and FIG. 13, various arrangements of local observation flaps 73 and exhaust pipes 74 are shown. Each of the end door sub-portions 53 may be provided with local flaps 73 as needed for inspection or with exhaust/feeder pipes 74 for loading, sampling and unloading. FIG. 12A shows an upper end flap portion 51 flanked by a pair of feeder pipes 74 to close an opening above the highest tier of sub-portions 53. In FIG. 12B, upper end flap portion 51 extends completely across the opening above the tiers of end door sub-portions 53. In FIG. 12C, an exhaust-/feeder pipe 74 extends across the entire opening above the tiers. In FIG. 13, an auxiliary flap portion 151 is located below upper end flap portion 51 to increase the effective height of the tiers of end door sub-portions 53.

Figure 16D:
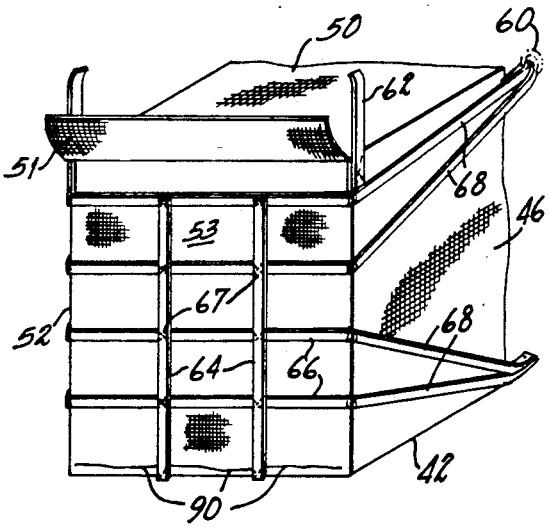

Shooters 84 may be provided for unloading wherever desired in door wall portion 52. FIG. 16A shows a series of horizontally aligned shooters 84 replacing sub-portions 53 along the lowest tier of sub-portions 53. In FIG. 16B, a shooter 84 extends the entire length of the lowest tier. The shape of the shooters 84 is rectangular in the previous figures. In FIG. 16C, shooter 84 is constructed with a floor and sidewalls, but no roof. In FIG. 16D, door wall portion 52 is not provided with a shooter and unloading may be accomplished by slitting door wall portion 52 such as shown by reference number 90. A flap portion 51 shown in FIGS. 16A-16D does not have an inner inspection flap 73, but may be so provided. In other words, the design of exit door portion 52 is flexible depending on the demands for loading, inspecting and/or unloading. Shooters 84 can be closed by rolling and tying or sewing supplemental straps 89 (see FIGS. 16A, 16B and 16C) until the time it is necessary to unload the cargo.

Oblique reinforcing straps 68 are shown in FIGS. 1 and 2 with lower forward ends 70 attached to floor 22 and upper rear ends 69 attached to reinforcing straps 64 and 66 at their intersections 67. However, oblique reinforcing straps may be attached to or extend from any reinforcing strap 64 or 66 in spaced relation to intersections 67 and may extend in an oblique forward direction either downward toward floor 22 or upward to a convenient top cargo ring 60. FIG. 16D shows an embodiment wherein an oblique reinforcing strap 68 extends along sidewall portion 46 from an end of a horizontally extending reinforcing strap 66 obliquely upwardly to an upward and inward attachment to a suitable top cargo ring 60 shown in phantom. A similar connection may be made along sidewall portion 44. FIG. 16D also shows oblique reinforcing straps 68 attached at their upper rear ends to relatively low horizontally extending reinforcing straps 66 of end door portion 52 and at lower forward ends to a container floor 22 on which insert floor portion 42 rests in the manner of FIG. 1. The reinforcements provided by attaching certain oblique reinforcing straps to cargo rings supplement the reinforcement obtained from oblique reinforcing straps connected to the container floor.

Conforming to requirements of the patent statutes, the present invention has been described in terms of a preferred embodiment and various modifications thereof. It is understood, however, that further modifications may be made in the light of the description that has been made and that the scope of the protection provided is defined by the claimed subject matter that follows.

What is claimed is:

1. A flexible insert for installation within a container of generally rectangular configuration having a generally planar floor, a generally planar left side wall extending upwardly from one side of said floor, a generally planar right side wall extending upwardly from the opposite side of said floor, a first generally planar closed end front wall extending upwardly between said side walls from one end of said floor, a generally planar door wall extending upwardly from the opposite end of said floor between said side walls, and a generally planar roof interconnecting the upper ends of said left and right side walls, and a plurality of cargo rings spaced along the perimeter portion of said roof, said insert being constructed and arranged to fit within said container when folded and to be unfolded to form a floor portion generally coextensive with said generally planar floor, left and right side wall portions generally coextensive with said left and right side walls, a closed front end portion generally coextensive with said closed end front wall, a roof portion generally coextensive with said roof, an end door portion and an end flap portion constructed and arranged to overlap said end door portion so that said end door portion and end flap portion is generally coextensive with said door wall when said end flap portion overlaps said end door portion, strap means extending outwardly and upwardly from said insert in position to cooperate with at least some of said cargo rings to suspend said insert from said rings in such a manner that said floor portion rests smoothly on said floor, said end door portion having a plurality of vertically spaced horizontally extending reinforcing straps and a plurality of horizontally spaced, vertically extending reinforcing straps, a plurality of obliquely extending interior reinforcing straps, each having a lower forward end secured to said floor portion to reinforce the latter and an upper rearward end secured to at least one of said reinforcing straps in said end door portion, said obliquely extending straps being constructed and arranged to be taut to support said end door portion in position to close at least a portion of said door portion to keep granular material or a liquid stored within said insert and said container, said obliquely extending reinforcing straps increasing the resistance of said end door portion to deform in response to pressure from a cargo within said insert when said obliquely extending straps are extended to be taut.

2. A flexible insert as in claim 1, further including at least one additional reinforcing strap having an upper forward end attached to one of said cargo rings and a lower rearward end secured to at least one of said reinforcing straps in said end door portion.

3. A flexible insert as in claim 1, wherein said horizontally extending reinforcing straps and said vertically extending reinforcing straps criss-cross each other to subdivide said end door portion into a plurality of vertically aligned, horizontally extending tiers of end door sub-portions and form intersections connected to the upper rearward ends of said obliquely extending reinforcing straps.

4. A flexible insert as in claim 3, further including a front flap portion interconnecting the bottom of said closed end wall portion to said floor portion and a rear flap portion interconnecting the bottom of said end door portion to said floor portion, said flap portions being constructed and arranged to receive means securing said front and rear flap portions to said floor without requiring an installer to fix the insert to the container without entering the insert.

5. A flexible insert as in claim 4, where said lower ends of said obliquely extending reinforcing straps extend through slot means in said floor portion, are folded rearwardly under said floor portion to provide floor portion reinforcing means and are secured to said floor and constructed and arranged to receive means securing said floor portion reinforcing means and said floor portion to said floor intermediate said front flap portion and said rear flap portion.

6. A flexible insert as in claim 4, wherein said vertically extending reinforcing straps are provided with lower extension portions attached to said rear flap portion.

7. A flexible insert as in claim 4, wherein said front flap portion interconnecting said floor portion to said closed end wall portion is reversely folded and said rear flap portion interconnecting said floor portion to said end door portion is reversely folded, said reversely folded flap portions being constructed and arranged to receive means attaching same to the floor of said container.

8. A flexible insert as in claim 3, further including a rearwardly folded portion of said lower forward ends forming floor portion reinforcing means attached to different areas of said floor portion and wherein a different one of said obliquely extending straps interconnects said floor portion along a unique transversely extending area of attachment across said floor portion at its lower forward end and to a unique intersection between one of said vertically extending reinforcing straps and one of said horizontally extending reinforcing straps at its upper rearward end.

9. A flexible insert as in claim 3, wherein a plurality of said obliquely extending reinforcing straps is connected at their lower forward ends to a common forward transversely extending area of attachment and at their upper rearward ends to a different intersection between said vertically extending reinforcing straps and said horizontally extending reinforcing straps.

10. A flexible insert as in claim 3, wherein at least a selected one of said sub-portions is provided with a closeable flap.

11. A flexible insert as in claim 3, wherein said upper end flap portion extends transversely between the rear ends of said side wall portions above each of said tiers.

12. A flexible insert as in claim 11, further including an exhaust pipe flanking each side of said upper end flap portion.

13. A flexible insert as in claim 3, wherein said upper end flap portion extends generally horizontally completely across an opening above said tiers.

14. A flexible insert as in claim 13, further including a local observation flap for said upper end flap portion.

15. A flexible insert as in claim 3, wherein at least two of the end door sub-portions are provided with shooters.

16. A flexible insert as in claim 3, further including an auxiliary flap portion constructed and arranged to cooperate with said tiers of said end door sub-portions to increase the effective height of said door portion.

17. A flexible insert as in claim 3, wherein the lowermost of said horizontally extending tiers is provided with a shooter.

18. A flexible insert as in claim 1, further including a a slot in said floor portion to receive a lower end of at least one of said obliquely extending reinforcing straps at its lower end and reinforcing flap means attached to said floor portion to close each said slot and further reinforce said floor portion.

19. A method of inserting a prefabricated flexible insert within a generally rectangularly shaped container without requiring the installer to enter said insert during said insertion, said container having a floor of generally planar shape, a pair of side walls of generally planar shape, a closed front end wall of generally planar shape, a roof of generally planar shape having longitudinally spaced cargo rings including innermost, intermediate and outermost rings attached thereto near the edge of the roof and a rear door wall, said flexible insert being unfoldable from a flat configuration into a generally planar shape having a floor portion generally conforming to said floor, a pair of side wall portions generally conforming to said side walls, a closed front end wall portion generally conforming to said closed front end wall, a roof portion conforming generally to said roof, an upper end flap portion extending from said roof portion and an end door wall portion cooperating with said upper end flap portion to conform generally with said end door wall when said upper end flap portion overlaps said end door wall portion, a front flap portion of reversely folded material connecting the front end of said floor portion to a bottom end of said closed front wall portion and a rear flap portion of reversely folded material connecting the rear end of said floor portion to said end door wall portion, and interior reinforcing means having a lower forward portion attached to said floor portion and an upper rear portion attached to said end door wall portion and constructed and arranged to extend obliquely upwardly and rearwardly from its forward portion to its rear portion when said flexible insert is unfolded to extend tightly along its length to control outward bulging of said end door wall portion and a plurality of spaced straps arranged from innermost to outermost straps extending outwardly from said flexible insert adjacent its roof portion and constructed and arranged to be tied to corresponding of said plurality of longitudinally spaced cargo rings fixed to said roof, said method comprising inserting said insert in its flat configuration within said container with its floor portion resting on said floor as far forward as possible within said container, folding said rear flap portion forwardly toward said front flap portion to expose said lower forward portion of said reinforcing means, attaching said front flap portion and the exposed lower portion of at least one of said reinforcing means to said floor, attaching its innermost straps to the innermost rings by lifting the insert near its innermost straps while leaving the innermost portion of said insert attached to the innermost portion of said floor and said exposed lower portion to said floor, attaching intermediate straps adjacent to said innermost straps to corresponding intermediate rings adjacent to said innermost rings, while maintaining said innermost and adjacent intermediate portions of said floor portion attached to corresponding portions of said floor, attaching said floor portion of said insert to said floor to the rear of the vicinity of said lower forward portion of said reinforcing means and continuing to lift next adjacent intermediate straps and attaching them to next adjacent intermediate rings to suspend an increasing length portion of said insert from an increasing length portion of said roof while attaching next adjacent floor portions of said insert against next adjacent portions of said floor, until said strap to ring attachments keep said insert open and its floor portions attached to said floor along substantially their entire length, and attaching said rear flap portion to said floor to maintain said floor portion unwrinkled after attaching said straps to said rings along the length of said insert to enable said insert to receive granular or fluid materials for storage without transferring the load from said received materials to said insert and to enable said tightly extending reinforcing means to increase the resistance of said end door portion to deform outwardly in response to pressure from a cargo within said insert.

20. A method as in claim 19, wherein at least one of said reinforcing means is attached at its rear end to an end door portion reinforcing strap adjacent one of said side wall portions further comprising extending said reinforcing means obliquely upwardly along said side wall portion from said reinforcing strap and connecting the opposite end of said reinforcing means to one of said cargo rings to reinforce the resistance of said end door portion to bulge outwardly.

* * * * *